United States Patent [19]

Kleps

[11] 4,377,240

[45] Mar. 22, 1983

[54] TOWEL SUPPORTING FIXTURE

[76] Inventor: Robert A. Kleps, 1142 S. Kenilworth, Oak Park, Ill. 60304

[21] Appl. No.: 208,853

[22] Filed: Nov. 21, 1980

Related U.S. Application Data

[63] Continuation-in-part of Ser. No. 63,842, Aug. 6, 1979, abandoned.

[51] Int. Cl.[3] ..... A47F 5/08

[52] U.S. Cl. ..... 211/87

[58] Field of Search ..... 211/6, 87, 30, 32, 33

[56] References Cited

U.S. PATENT DOCUMENTS

| | | | |
|---|---|---|---|
| 1,939,027 | 12/1933 | Stewart | 211/32 |
| 1,965,773 | 7/1934 | Jacobs | 211/32 |
| 2,060,711 | 11/1936 | Wright | 211/32 |
| 2,707,564 | 5/1955 | Smith | 211/32 |
| 3,973,676 | 8/1976 | Brooks | 211/87 |

FOREIGN PATENT DOCUMENTS

| | | | |
|---|---|---|---|
| 616335 | 10/1926 | France | 211/6 |

*Primary Examiner*—Francis K. Zugel
*Assistant Examiner*—Robert W. Gibson, Jr.
*Attorney, Agent, or Firm*—Robert G. Petrinec

[57] ABSTRACT

A towel supporting fixture is provided with a one piece special plateau having a rigid frictional upper surface means formed integral wherewith. The special plateau is held by a bracket so that towels or other similar articles placed thereon are secured thereto substantially completely by frictional engagement. The frictional surface is omni directional and towels can be removed by pulling in any direction. The plateau may be planar in configuration or it may be a horizontally disposed ring held in spacial relation by the bracket. Also the plateau may be removably secured to the bracket so that plateaus of different configurations can be interchanged with brackets of the same or different design.

6 Claims, 5 Drawing Figures

TOWEL SUPPORTING FIXTURE

CROSS REFERENCE TO RELATED APPLICATION

This is a continuation-in-part of application Ser. No. 63,842, filed Aug. 6, 1979 now abandoned.

BRIEF DESCRIPTION OF THE PRIOR ART

Prior art towel racks generally provide a bar having the ends thereof held by brackets so that the bar is held away from a wall, or other similar vertical surface, and a towel can be draped over the bar. In this case, the towel is placed over the towel bar so that approximately one half of the towel is placed on one side of the bar and the other half is on the other side of the bar. The towel is held substantially by a balance of gravitational force. Such prior art devices are shown in U.S. Pat. Nos. 1,692,059 and 2,052,606. To improve on this basic towel rack arrangement, a frictional surface was provided on the bar to hold the towels and other articles more securely. However, this arrangement still required the towel or other articles to be placed over the towel bar so that substantially one half of the towel is on one side of the bar and the other half of the towel is on the other side of the bar. This arrangement is shown in U.S. Pat. No. 2,052,606.

Another prior art towel supporting fixture utilizes a ring through which the towel is placed. This structure is in U.S. Pat. No. 2,576,873.

Still other prior art towel rack arrangement uses locking means to hold the towel or other articles firmly in place. Such structures are shown in U.S. Pat. Nos. 1,691,412; 2,521,604; 2,590,297; and 2,606,667. The disadvantage of these types of towel racks is that they require the user to take time and effort to place the towel in the holding mechanism. Therefore, they are difficult for children to use.

Yet another prior art arrangement is shown in Brooks, U.S. Pat. No. 3,973,676. This patent uses a hollow half sphere of flexible material placed over the upper end of an arm of similar shape. The half sphere includes a series of soft spine-like projections over its outer surface. This type of device is complex and expensive to manufacture.

BRIEF SUMMARY OF THE INVENTION

Accordingly, it is an object of the present invention to provide a new and improved towel supporting fixture which over-comes the disadvantages of the prior art and which is inexpensive to manufacture. The towel supporting fixture of this invention is a one piece plateau and frictional surface which allows for casual placement of towels and other articles thereon. Towels need not be placed so that one half is on one side of the rack and the other half on the other side of the towel rack.

Another object of the present invention is to provide a new and improved towel supporting fixture which is easy to use by children.

Still another object of the present invention is to provide a towel rack which will hold towels, and other similar articles, substantially completely by friction.

Yet other objects of the present invention are to provide a towel rack which will receive and hold towels of any size, and to provide a towel rack which provides for better drying of damp towels.

Briefly, the towel supporting fixture of this invention includes a support bracket that can be secured to a wall or other similar vertical surface. The bracket may be arranged for connection to a vertical post or it may be part of a post or standard. A plateau member is mounted on the bracket so that the plateau member is in spacial relation at a predetermined position. The plateau member may be either permanently secured to the bracket or it may be removably secured to the bracket. The plateau member may be planar, concave or convex in configuration. Also, the plateau member may be round, or polygonal, as well as being either solid or formed of a ring.

In accordance with this invention the plateau member has formed thereon a frictional surface and is one piece therewith. The frictional surface is rigid and omni directional so that towels can be removed by pulling the towel across the plateau in any direction.

Many other objects, features and advantages of the present invention will be more fully realized and understood from the following detailed description when taken in conjunction with the following drawings wherein like reference numerals throughout the various views of the drawing are intended to designate similar elements or components.

DETAILED DESCRIPTION OF THE ILLUSTRATED EMBODIMENTS

Figure 1:
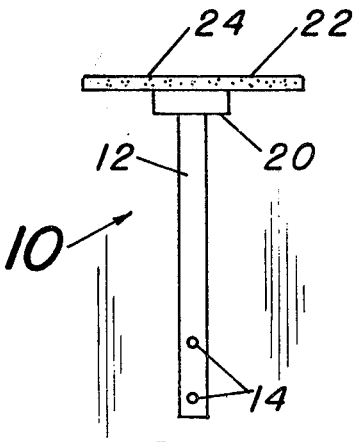
FIG. 1 is a front elevational view of the towel supporting fixture of the present invention.
Figure 2:
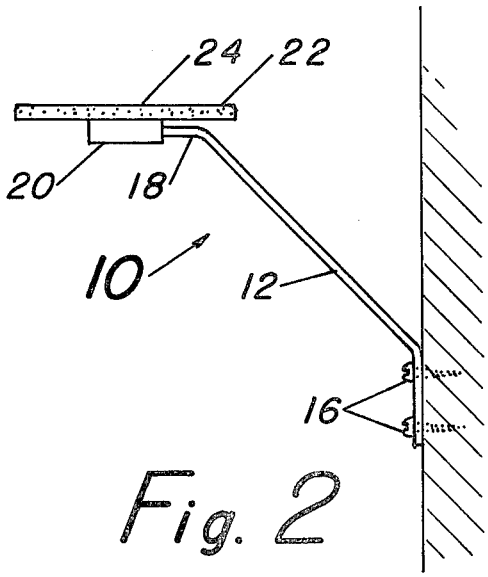
FIG. 2 is a side elevational view of the towel supporting fixture of FIG. 1.
Figure 3:
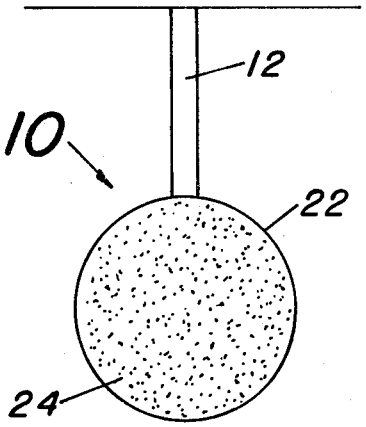
FIG. 3 is a top view of the towel supporting fixture of FIG. 1.
Figure 4:
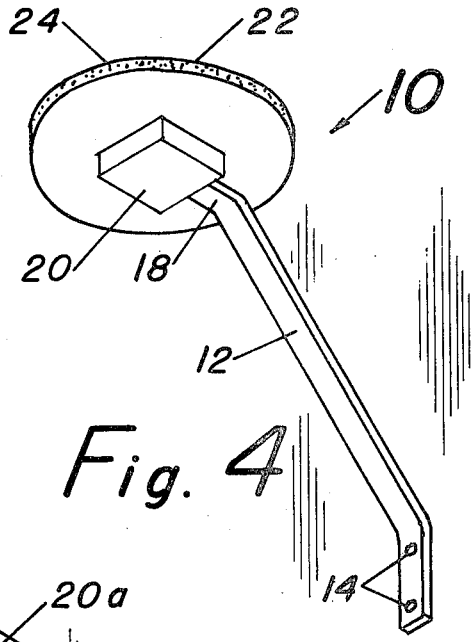
FIG. 4 is a perspective view of the towel supporting fixture of FIGS. 1, 2 and 3.

Referring now to FIGS. 1, 2, 3 and 4, one form of the towel supporting fixture of this invention is shown in detail and is designated generally by reference numeral 10. The towel supporting fixture 10 includes a support bracket 12, which is shown here as being made of a flat metal member. The bracket 12 may be made of any suitable material and have any suitable cross section without departing from this invention. The bracket 12 is provided with a pair of fastener holes 14 which receive fasteners 16, as seen in FIG. 2. The bracket 12 has a free end 18 engaged with a mounting element 20. The free end 18 may be permanently secured to the mounting element 20 or it may be removably secured thereto, or it may be formed integral therewith.

In accordance with the present invention, plateau means 22 is secured to the bracket 12 by the mounting element 20. The plateau means is formed as one piece with a frictional surface 24. The frictional surface is of sufficient area to receive and hold towels, or other similar articles, substantially completely by frictional force. The plateau and frictional surface are of rigid material such as unglazed ceramic. While the towel supporting fixture of this invention is shown formed of several separate elements, it will be understood that the fixture can be formed of a single molded unit having the bracket 12, mounting element 20 and plateau 22 as one piece. The unglazed ceramic provides an omni directional frictional surface so that towels can be pulled in any direction with equal force or effort to remove the towel from the support fixture. By providing the plateau means 22 in spacial relation, towels and other similar articles can be securely placed on the fixture 10 by a casual placement thereupon and removed easily in any direction. This, therefore, has particular advantage for small children as it is much easier to place items on and remove items from the towel fixture.

In the illustrated embodiment, the mounting element 20 is formed as part of the plateau 22. It will be understood, however, that the mounting element 20 may be part of the bracket 12. Also, the mounting element may provide a permanent connection between the plateau 22 and the bracket 12 or it may provide for a removable connection. This feature will provide for interchangeability between plateaus of different design and brackets of different design.

Figure 5:
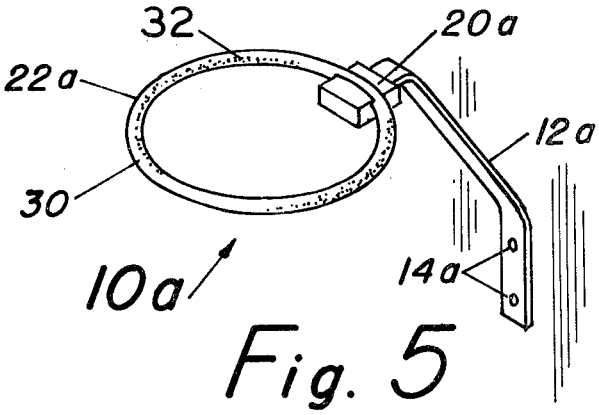
FIG. 5 is an alternate arrangement of the towel supporting fixture of the present invention.

FIG. 5 illustrates an alternate embodiment of the present invention and is here designated by reference numeral 10*a*. The towel supporting fixture 10*a* has the usual bracket 12*a* and mounting element 20*a*. However, a plateau means 22*a* is here shown as a horizontally disposed ring 30 having frictional means 32 formed as one piece with the ring 30 about the upper surface thereof.

While only two embodiments of the present invention are shown herein, it will be understood that variations and modifications may be made without departing from the spirit and scope of this invention.

What is claimed is:

1. A towel supporting fixture comprising in combination: support means for holding said fixture in a secure predetermined position; and a planar rigid plateau means having a uniformly disposed, upper, roughened, omni directional frictional surface for engaging a towel, said rigid plateau means and said frictional surface formed as a one-piece structure; and mounting means formed on the bottom of said rigid plateau means, said mounting means arranged for connection to said support means to hold said rigid plateau means in spacial relation at said predetermined position; whereby said rigid plateau means receives and holds a towel engaged with said towel engaging surface substantially completely by friction.

2. A towel supporting fixture as set forth in claim 1 wherein said rigid plateau means is circular.

3. A towel supporting fixture as set forth in claim 1 wherein said mounting means provides means for removably securing said rigid plateau means to said support means.

4. A towel supporting fixture as set forth in claim 1 wherein said support means is a bracket having at one end means for connection to vertical wall surface and having at the other end means for removable connection with said rigid plateau means.

5. A towel supporting fixture as set forth in claim 1 wherein said plateau means is circular in configuration, and wherein said support means is a bracket having at one end means for connection to a vertical wall surface, and having at the other end means for removable connection with said plateau means.

6. The towel supporting fixture as set forth in claim 1 wherein said rigid plateau means and said frictional surface formed integral therewith are made of unglazed ceramic.

* * * * *